US008062818B2

(12) United States Patent
Kouyama et al.

(10) Patent No.: US 8,062,818 B2
(45) Date of Patent: Nov. 22, 2011

(54) TONER FOR ELECTROSTATIC IMAGE DEVELOPMENT, FULL-COLOR TONER KIT AND IMAGE FORMING METHOD

(75) Inventors: Mikio Kouyama, Tokyo (JP); Hiroshi Yamazaki, Tokyo (JP); Ken Ohmura, Tokyo (JP); Kenji Hayashi, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 482 days.

(21) Appl. No.: 12/406,554

(22) Filed: Mar. 18, 2009

(65) Prior Publication Data

US 2009/0239164 A1 Sep. 24, 2009

(30) Foreign Application Priority Data

Mar. 22, 2008 (JP) ..... 2008-074757

(51) Int. Cl.
*G03G 9/09* (2006.01)

(52) U.S. Cl. ..... 430/108.1; 430/107.1

(58) Field of Classification Search ..... 430/107.1, 430/108.1

See application file for complete search history.

(56) References Cited

U.S. PATENT DOCUMENTS 6,001,524 A * 12/1999 Yoon et al. ..... 430/109.4

* cited by examiner

*Primary Examiner* — Hoa Le

(74) *Attorney, Agent, or Firm* — Lucas & Mercanti, LLP

(57) ABSTRACT

An electrophotographic toner for electrostatic image development which is capable of obtaining a high chroma full-color image exhibiting clear color without color contamination and excellent light stability is disclosed, comprising a resin and a colorant, wherein the colorant comprises a pigment of C.I. Pigment Blue 76. There are also disclosed a full-color toner kit and an image forming method by use of the toner.

12 Claims, 1 Drawing Sheet

TONER FOR ELECTROSTATIC IMAGE DEVELOPMENT, FULL-COLOR TONER KIT AND IMAGE FORMING METHOD

This Application claims the priority of Japanese Application No. 2008-074757, filed Mar. 22, 2008, the entire content of which is hereby incorporated by reference.

FIELD OF THE INVENTION

The present invention relates to toners for electrostatic image development used in electrophotographic image formation and in particular to a toner for electrostatic image development, containing C.I. Pigment Blue 76.

BACKGROUND OF THE INVENTION

Recently, image formation of an electrophotographic system, using a toner for electrostatic image development (hereinafter, also denoted simply as a toner) can perform full-color printing as well as mono-chromatic printing, as typified by conventional document preparation. Such a full-color image forming apparatus, which can prepare prints of the number of required sheets for on-demand printing without making any printing plate, has become mainly employed in the field of short-run printing, as described in, for example, JP-A No. 2005-15724 (hereinafter, the JP-A refers to Japanese Patent Application Publication).

When preparing full-color prints of catalogs or for advertisement using a toner, the toner used therein requires color reproducibility to obtain an image faithful to the original image. Namely, in full-color image formation, toner images of yellow, magenta and cyan are superimposed to reproduce the targeted color image and such color toners on which attainment of faithful color reproduction is based are required to achieve superior color reproducibility.

Recently, there have been increased opportunities to form graphic images on the display by a computer to output the image. The color gamut in conventional color printing or color photographic system is much narrower than that formed on the display so that outputting the image on the display as such on paper or the like has been limited in photographic prints for personal use or in commercial printing. Thus, a toner capable of expanding the color gamut can also achieve expanded color gamut, so that it was highlighted as a problem to be overcome to make it feasible to output prints with a color gamut close to that of the display.

Based on the foregoing background, there have been studied various colorants aimed to achieve enhanced color reproducibility.

There are included, for example, copper phthalocyanine pigments as one of typical cyan colorants used for color toners. Toners using such copper phthalocyanine pigments are versatile and exhibit superior light stability but result in an increased base line on the longer wavelength side of a reflection spectrum of the image and tend to form color images with slight color contamination. Therefore, such copper phthalocyanine pigments have been regarded not to be suitable for image formation demanding high color reproduction, as typified by prints of company logos.

Accordingly, there was studied development of a toner not causing color contamination by improving copper phthalocyanine pigments, as described in, for example, JP-A No. 5-239368, but which did not achieve sufficient reduction of color contamination.

Toners using pigments such as a copper phthalocyanine pigment exhibit versatility achieving image quality at the level of images prepared in printing inks but were difficult to attain a hue angle suited for color reproduction of photographic images. Accordingly, there were studied toners containing a colorant capable of achieving a hue angle suitable for color reproduction of a photographic image, as described in, for example, JP-A Nos. 5-239368 and 2006-63171.

SUMMARY OF THE INVENTION

It is an object of the present invention to provide a toner for electrostatic image development capable of obtaining a high chroma full-color image exhibiting clear color without color contamination and excellent light stability. In particular, it is an object to provide a toner for electrostatic image development which is feasible to adapt its hue angle to color reproduction of a photographic image and further is capable of forming a high chroma secondary color toner image.

One aspect of the invention is directed to an electrophotographic toner used for electrostatic image development comprising a resin and a colorant, wherein the colorant comprises a pigment of C.I. Pigment Blue 76.

Another aspect of the invention is directed to a full-color toner kit comprising at least four toners comprised of a yellow toner comprising a yellow colorant and a resin, a magenta toner comprising a magenta colorant and a resin, a cyan toner comprising a cyan colorant and a resin and a black toner comprising a black colorant and a resin, wherein the cyan colorant comprises a pigment of C.I. Pigment Blue 76.

Further, another aspect of the invention is directed to an image forming method comprising performing image formation by using at least four toners comprised of a yellow toner comprising a yellow colorant and a resin, a magenta toner comprising a magenta colorant and a resin, a cyan toner comprising a cyan colorant and a resin and a black toner comprising a black colorant and a resin, wherein the cyan colorant comprises a pigment of C.I. Pigment Blue 76.

The toner relating to the invention has achieved formation of a high chroma full-color image without color contamination has been formed and the farmed toner image has realized stable lightfastness over a long duration.

It has also become feasible to obtain a monochromatic color toner image of excellent tint without color contamination so that a secondary color formed by the toner of the invention exhibits clear color.

Further, enhanced tints have made it feasible to fit a hue angle of the toner to color reproduction of photographic images.

DETAILED DESCRIPTION OF THE INVENTION

Figure 1:
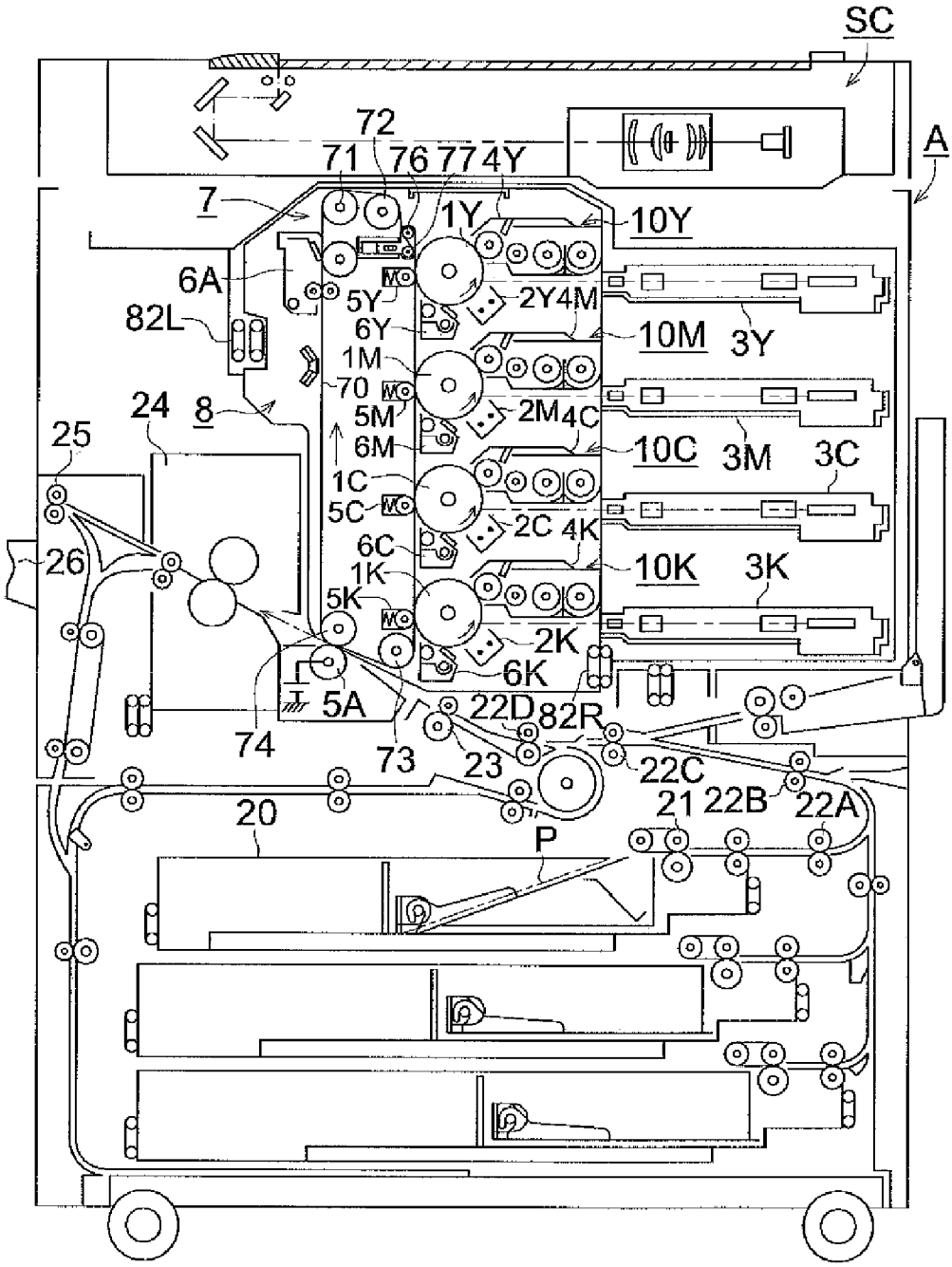
FIG. 1 illustrates an example of an image forming apparatus in which toners relating to the invention are usable.

The present invention relates to a toner for electrostatic image development containing at least a resin and a colorant and in particular to a toner for electrostatic image development, exhibiting excellent color which makes it feasible to fit a hue angle of the toner to color reproduction of a photographic image and resulting in stable lightfastness.

In the toner of the invention, excellent color has been effected without color contamination. The reason for effecting excellent color is presumed to be due to the fact that crystallinity of a colorant is weaker, as compared to conventional copper phthalocyanine pigments. In other words, it is assumed that polarity of a resin or a wax optimally acts onto the colorant through lower crystallinity of the colorant, which facilitates formation of homogeneous dispersion within a toner particle. Thus, it is presumed that such homogeneous dispersion of a colorant within a toner particle results in the colorant being homogeneously dispersed on a transfer sheet without causing unevenness when the toner particles melt in fixing, whereby clear color is easily obtained without color contamination. Even when forming a toner image of a secondary color, it is assumed that the colorant is easily dispersed together with other colorants, making it less likely to cause contamination and also making it easy to form a secondary color image of a clear and natural gradation.

Even when producing a toner by a process of polymerization, it is presumed that colorants are easily homogenized in a polymerizable monomer and coagulation of particles is performed, while the colorants being homogeneously dispersed in a resin particle dispersion, whereby a toner of a structure of the colorant being homogeneously dispersed is easily obtained.

In the toner relating to the invention, as described above, it is presumed that a colorant is readily and homogeneously dispersed within a toner particle or on a fixed image, achieving clear color without causing color contamination and the stable structure of a colorant molecule itself results in sufficient lightfastness.

In addition, a high molecular extinction coefficient is expected from homogeneous dispersion of a colorant within a toner particle or on a fixed image being easily performed, which makes it feasible to obtain sufficient image density at a relatively low colorant content. As a result, it is also expected to reduce toner consumption in image formation.

There will be further detailed the invention.

The toner relating to the invention contains at least a resin and a colorant, and the colorant contained in the toner comprises a pigment of C.I. Pigment Blue 76. C.I. Pigment Blue 76 refers to Color Index Generic Names. Such a pigment of C.I. Pigment Blue 76 is a chlorinated copper phthalocyanine (or copper polychlorophthalocyanine) having the chemical structure represented by the following formula:

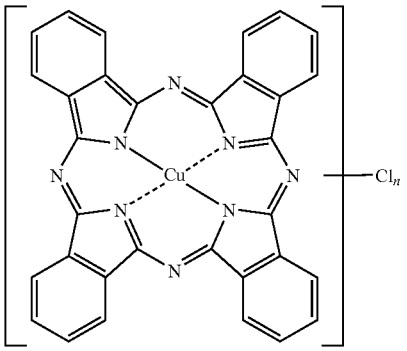

in which the number of chlorine atoms of a pigment of C.I. Pigment Blue 76 is 10 (n=10). A pigment of C.I. Pigment Blue 76 is a type of turquoise blue, as compared to conventional copper phthalocyanine pigments and is capable of expanding the color gamut. Its high lightness can achieve expansion of the color gamut, specifically in the region of yellowish green, green and light blue. Further, lightfastness is also excellent, which can inhibit variation of tints. Examples of a commercially available pigment of C.I. Pigment Blue 76 include FASTOGEN Blue 10GN (produced by DAINIPPON INK & CHEMICALS, INC.).

In the toner relating to the invention, the use of the above-described colorant makes it feasible to realize broader and more stable color reproduction than conventional toner images or images obtained by using printing ink.

A pigment of C.I. Pigment Blue 76, used in the invention (hereinafter, also denoted simply as C.I. Pigment Blue 76) is dispersed in a toner, and preferably exhibiting a number average primary particle size of from 10 to 300 nm, and more preferably from 10 to 200 nm. In the invention, when observing a 1000-fold magnified transmission electron micrograph of a section of a toner particle to determine the Feret's diameter of colorant particles, the number average primary particle size of colorant particles is defined as the arithmetic average diameter of colorant particles when observing ten toner particles.

C.I. Pigment Blue 76 is contained in a toner preferably in an amount of from 1 to 10% by mass of the toner and more preferably from 3 to 7% by mass. Coloring power of a toner may be sufficient when added in an amount of not less than 1% by mass, and a colorant may not leave a toner or not be attached to a carrier when added in an amount of not more than 10% by mass, adversely affecting a charging property of a toner.

In addition of C.I. Pigment Blue 76, there may be added other cyan colorants known in the art, such as a copper phthalocyanine. Such a known colorant is added preferably in an amount of less than 50% by mass of C.I. Pigment Blue 76. Addition of less than 50% by mass facilitates to achieve advantageous effects of the invention.

In the invention, constitution of plural chromatic toners can realize a full-color toner kit which renders it feasible to form a full-color toner image. Namely, a full-color toner kit constituted of at least four toners of a cyan toner comprised of at least colorants including C.I. Pigment Blue 76 and a resin, a yellow toner comprised of at least a yellow colorant and a resin, a magenta toner comprised of at least a magenta colorant and a resin and a black toner comprised of at least a black colorant and a resin enables formation of full-color images.

There will be described colorants used for toners constituting a full-color toner kit relating to the invention. Examples of a colorant used for a black toner include carbon black, a magnetic material and titanium black. Specific examples of carbon black include channel black, furnace black, acetylene black, thermal black and lamp black. Examples of a magnetic material include ferromagnetic metals of iron, nickel, cobalt and the like and alloys containing these metals; compounds of ferromagnetic metals such as ferrite and magnetite; and alloys which contain no ferromagnetic metal but exhibit ferromagnetism upon a thermal treatment. Examples of such an alloy exhibiting ferromagnetism upon a thermal treatment include so-called Heusler's alloy of manganese-copper-aluminum or manganese-copper-tin; and chromium dioxide.

Examples of a yellow colorant used for a yellow toner include dyes such as C.I. Solvent Yellow 19, ibid 44, ibid 77, ibid 79, ibid 81, ibid 82, ibid 93, ibid 98, ibid 103, ibid 104, ibid 112 and ibid 162; and pigments such as C.I. Pigment Yellow 14, ibid 17, ibid 74, ibid 93, ibid 94, ibid 138, ibid 155, ibid 180 and ibid 185. A mixture of these dyes or pigments may also usable, of these, C.I. Pigment Yell 74 is preferred.

Examples of a magenta colorant used for a magenta toner include dyes such as C.I. Solvent Red 1, ibid 49, ibid 52, ibid 58, ibid 631 ibid 111 and ibid 122; and pigments such as C.I. Pigment Red 5, ibid 48, :1, ibid 53:1, ibid 57:1, ibid 122, ibid 139, ibid 144, ibid 149, ibid 166, ibid 177, ibid 178 and ibid 133. A mixture of these dyes or pigments may also usable. Of these, C.I. Pigment Red 122 is preferred.

The number average primary particle size of a colorant dispersed in a toner, depending on the kind of a colorant, is preferably from 10 to 200 nm. A colorant is added in an amount of from 1 to 10% by mass, and preferably from 2 to 8% by mass. Coloring power of a toner may be sufficient when added at not less than 1% by mass, and a colorant may not leave a toner or not be attached to a carrier when added at not more than 10% by mass, adversely affecting a charging property of a toner.

The use of a full-color toner kit which is comprised of at least a yellow toner, a magenta toner, a black toner and a cyan toner containing C.I. Pigment Blue 76 enables to perform full-color toner image formation.

There will be further described particle size of the toner of the invention.

The toner relating to the invention comprises toner particles, which preferably exhibit a volume-based median diameter (also denoted simply as D50v) of not less than 3 μm and not more than 8 μm. The use of a toner exhibiting a volume-based median diameter falling within the foregoing region enables faithful reproduction of fine-dot images, for example, at a level of 1200 dpi (dpi: the number of dots per inch or 2.54 cm).

The minute particle size level at a volume-based median diameter falling within the minute particle size enables to obtain a highly precise photographic image in which a dot image constituting the photographic image is equivalent to or more than a high-precision printed image. Specifically, in on-demand printing in which orders for several hundreds to several thousands sets are often received, high image quality prints with high-precision photographic images can be delivered to a user.

The volume-based median diameter (D50v) of toner particles can be determined using COULTER MULTISIZER 3 (Beckmann Coulter Co.), connected to a computer system for data processing.

The measurement procedure is as follows: 0.02 g of toner particles are added to 20 ml of a surfactant solution (for example, a surfactant solution obtained by diluting a surfactant containing neutral detergent with pure water to a factor of 10) and dispersed by an ultrasonic homogenizer to prepare a toner dispersion. Using a pipette, the toner dispersion is poured into a beaker having ISOTON II (produced by Beckman Coulter Co.) within a sample stand, until reaching a measurement concentration of 5 to 10%. The measurement count was set to 2,500 to perform measurement. Then aperture diameter of MULTISIZER 3 was 50 μm.

The toner of the invention preferably exhibits a coefficient of variation (CV value) of volume-based particle size distribution of not less than 2% and not more than 21%, more preferably not less than 5% and not more than 15%. The coefficient of variation (also denoted simply as CV value) of volume-based particle size distribution represents a degree of variance of particle size distribution, based on volume and defined as below:

CV value (%)={(standard deviation of volume-based particle size distribution)/[median diameter (*D*50*v*) of volume-based particle size distribution]}×100

A low value indicates a sharper particle size distribution and means that the particle size tends to be uniform. Uniform particle size enables more precise reproduction of fine-dot images or fine lines, as is essential in digital image formation. Printing a photographic image with uniform-sized toner particles results in photographic images of high image quality at a level equivalent to or higher than an image prepared by printing ink.

The toner of the invention preferably exhibits a softening point at a temperature of from 70 to 110° C., and more preferably from 70 to 100° C. Colorants used in the toner of the invention are stable, causing no change in spectrum even when affected by heat. A softening point falling within the foregoing range can reduce effects of heat applied to the toner in fixing. Accordingly, image formation is performed without relying on a colorant, so that it is expected to, develop broad stable-color reproduction.

A toner of a softening point falling within the foregoing range enables fixing a toner image at a lower temperature than the prior art, rendering it feasible to perform image formation friendly to environments at reduced power consumption.

The softening point of a toner can be controlled by the following methods, singly or in combination. Thus, (1) the kind or the composition of monomer used for resin formation is adjusted; (2) the molecular weight of a resin is controlled by the kind or the amount of a chain-transfer agent; (3) the kind or amount of a wax is controlled.

The softening point of a toner may be measured by using, for example, Flow Tester CFT-500 (produced by Shimazu Seisakusho Co., Ltd.). Specifically, a sample which is molded to a 10 mm high column, is compressed by a plunger at a load of $1.96\times10^6$ Pa with heating at a temperature rising rate of 6° C./min and extruded from a 1 mm long nozzle, whereby, a curve (softening flow curve) between plunger-drop and temperature is drawn. The temperature at which flowing-out is initiated is defined as the fusion-initiation temperature and the temperature corresponding to 5 mm drop is defined as the softening temperature.

There will be described a method of preparing the toner of the invention.

The toner of the invention is comprised of particles containing at least a resin and a colorant (hereinafter, also denoted as colored particles). The colored particles constituting the toner of the invention are not specifically limited but can be prepared according the convention methods for preparing toners. More specifically, preparation is feasible by applying, for example, a so-called grinding method for preparing a toner through kneading, grinding and classification or a preparation method of a polymer toner in which a polymerizable monomer is polymerized with controlling the shape or size of particles to achieve particle formation (for example, emulsion polymerization, suspension polymerization, or polyester elongation).

When preparing the toner of the invention through a grinding method, kneading is performed with maintaining a temperature at not more than 130° C. When kneading a mixture at a temperature not exceeding 130° C., heating action applied to the mixture does not tend to cause variation in the coagulation state of a colorant, rendering it easy to maintain uniform colorant coagulation. It is a concern that variation in the coagulation state causes variations in color of the prepared toner, leading to color contamination.

Next, there will be described resin and wax constituting the toner of the invention, with reference to examples.

Resins usable for the toner of the invention are not specifically limited but are typically polymers formed by polymerization of polymerizable monomers which are called vinyl monomers. A polymer constituting a resin usable in the invention is constituted of a polymer obtained by polymerization of at least one polymerizable monomer, which is a polymer prepared by using vinyl monomers singly or in combination.

Specific examples of a polymerizable vinyl monomer are below:

(1) styrene or styrene derivatives:
styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene, and p-n-dodecylstyrene;

(2) methacrylic acid ester derivatives:
methyl methacrylate, ethyl methacrylate, n-butyl methacrylate, iso-propyl methacrylate, iso-butyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate;

(3) acrylic acid ester derivatives:
methyl acrylate, ethyl acrylate, iso-propyl acrylate, n-butyl v, t-butyl acrylate, iso-butyl acrylate, n-octyl acrylate, 2-ethylhexyl acrylate, stearyl acrylate, lauryl acrylate and phenyl acrylate;

(4) olefins:
ethylene, propylene and isobutylene;

(5) vinyl esters:
vinyl propionate, vinyl acetate and vinyl benzoate;

(6) vinyl ethers:
vinyl methyl ether and vinyl ethyl ether;

(7) vinyl ketones:
vinyl methyl ketone, vinyl ethyl ketone and vinyl hexyl ketone;

(8) N-vinyl compounds:
N-vinyl carbazole, N-vinyl indole and N-vinyl pyrrolidone;

(9) others:
vinyl compounds such as vinylnaphthalene and vinylpyridine; acrylic acid or methacrylic acid derivatives such as acrylonitrile, methacrylonitrile and acrylamide.

There may also usable polymerizable monomers containing ionic-dissociative group, as a vinyl monomer, and including, for example, those having a side chain containing a functional group such as a carboxyl group, a sulfonic acid group or a phosphoric acid group.

Specific examples include carboxyl group containing monomers such as acrylic acid, methacrylic acid, maleic acid, itaconic acid, cinnamic acid, fumaric acid, monoalkyl maleate, monoalkyl itaconate; sulfonic acid group containing monomers such as styrenesulfonic acid, allylsulfosuccinic acid, 2-acrylamido-2-methylpropanesulfonic acid; and phosphoric acid group containing monomers such as acid phosphooxyethyl methacrylate.

Further, a cross-linked resin can be obtained using polyfunctional vinyls such as divinylbenzene, ethylene glycol dimethacrylate, ethylene glycol diacrylate, triethylene glycol dimethacrylate, triethylene glycol diacrylate, neopentylglycol dimethacrylate and neopentylglycol diacrylate.

Resins usable in the invention include a polyester resin obtained by polycondensation of an acid anhydride or a polyvalent carboxylic acid having at least two carboxyl groups and a polyvalent alcohol having at least two hydroxyl groups. Specific examples of a polyvalent carboxylic acid include aliphatic dicarboxylic acids such as citric acid, malonic acid, maleic acid, fumaric acid, citraconic acid, itaconic acid, glucuronic acid, succinic acid, adipic acid, sebacic acid, n-dodecylsuccinic acid, n-dodecylsuccinic acid and n-dodecenylsuccinic acid; alicyclic dicarboxylic acids such as hexanedicarboxylic acid and aromatic dicarboxylic acids such as phthalic acid, isophthalic acid and terephthalic acid. Specific examples of a polyvalent alcohol include aliphatic diols such as 1,2-propanediol, 1,3-propanediol, 1,4-butanediol, 1,5-pentanediol, 1,6-hexanediol, 1,7-heptanediol, 1,8-octanediol, neopentyl glycol, and 1,4-butenediol; aromatic diols such as an alkylene oxide adduct of bisphenol A; and polyols such as glycerin, pentaerythritol, trimethylolpropane, and sorbitol. These polyvalent alcohols may be combined.

The content of a resin contained in the toner relating to the invention is preferably from 60 to 95% by mass, and more preferably from 70 to 90% by mass.

Waxes usable in the toner of the invention are those known in the art. Examples thereof include:

(1) polyolefin wax such as polyethylene wax and polypropylene wax;

(2) long chain hydrocarbon wax such as paraffin wax and sasol wax;

(3) dialkyl ketone type wax such as distearyl ketone;

(4) ester type wax such as carnauba wax, montan wax, trimethylolpropane tribehenate, pentaerythritol tetramyristate, pentaerythritol tetrabehenate, pentaerythritol diacetate dibehenate, glycerin tribehenate, 1,18-octadecanediol distearate, trimellitic acid tristearate, and distearyl meleate; and (5) amide type wax such as ethylenediamine dibehenylamide and trimellitic acid tristearylamide.

The melting point of a wax usable in the invention is preferably 40 to 125° C., more preferably 50 to 120° C., and still more preferably 60 to 90° C. A melting point falling within the foregoing range ensures heat stability of toners and can achieve stable toner image formation without causing cold offsetting even when fixed at a relatively low temperature. The wax content of the toner is preferably in the range of 1% to 30% by mass, and more preferably 5% to 20%.

There may be incorporated, in the process of preparing the toner of the invention, inorganic organic microparticles having a number-average primary particle size of 4 to 800 nm as an external additive to prepare the toner.

Incorporation of an external additive results in improved fluidity or electrostatic property or achieves enhanced cleaning ability. The kind of external additives is not specifically limited and examples thereof include inorganic microparticles, organic microparticles and a sliding agent, as described below.

There are usable commonly known inorganic microparticles and preferred examples thereof include silica, titania, alumina and strontium titanate microparticles. There may optionally be used inorganic microparticles which have been subjected to a hydrophobilization treatment.

Specific examples of silica microparticles include R-976, R-974, R-972, R-812 and R-809 which are commercially available from Nippon Aerosil Co., Ltd.; HVK-2150 and H-200 which are commercially available from Hoechst Co.; TS-720, TS-530, TS-610, H-5 and MS-5 which is commercially available from Cabot Co.

Examples of titania microparticles include T-805 and T-604 which are commercially available from Nippon Aerosil Co. Ltd.; MT-100S, MT-100B, MT-500BS, MT-600, MT-600SJA-1 which are commercially available from Teika Co.; TA-300SI, TA-500, TAF-130, TAF-510 and TAF-510T which as commercially available from Fuji Titan Co., Ltd.; IT-S, IT-OB and IT-OC which as commercially available from Idemitsu Kosan Co., Ltd.

Examples of alumina microparticles include RFY-C and C 604 which are commercially available from Nippon Aerosil Co., Ltd.; and TTO-55, commercially available from Ishihara Sangyo Co., Ltd.

Spherical organic microparticles having a number-average primary particle size of 10 to 2000 nm are usable as organic microparticles. Specifically, there is usable styrene or methyl methacrylate homopolymer or their copolymers.

There are also usable lubricants, such as long chain fatty acid metal salts to achieve enhanced cleaning ability or transferability. Examples of a long chain fatty acid metal salt include zinc, copper, magnesium, and calcium stearates; zinc, manganese, iron, copper and magnesium oleates; zinc, copper, magnesium, and calcium palmitates; zinc and calcium linolates; zinc and calcium ricinolates.

Such an external additive or lubricant is incorporated preferably in an amount of 0.1 to 10.0% by weight of the total toner. The external additive or lubricant can be incorporated by using commonly known mixing devices such as a turbuler mixer, a HENSCHEL MIXER, a Nauter mixer or a V-shape mixer.

The toner of the invention is usable as a two-component developer comprised of a carrier and a toner, or a single-component developer comprised of a toner alone.

The use of the toner of the invention as a two-component developer enables full-color printing by using a tandem system image forming apparatus, as described later.

Magnetic particles used as a carrier of a two-component developer can use commonly known materials, e.g., metals such as iron, ferrite and magnetite and alloys of the foregoing metals and metals such as aluminum or lead. Of these, ferrite particles are preferred. The volume-average particle size of a carrier of a carrier is preferably from 15 to 100 μm. and more preferably from 25 to 80 μm.

When used as a nonmagnetic single-component developer without a carrier to perform image formation, a toner is charged with being rubbed or pressed onto a charging member or the developing roller surface, image formation in a nonmagnetic single-component development system can simplify the structure of a developing device, leading to a merit of compactification of the whole image forming apparatus. Therefore, the use of the toner of the invention as a single-component developer can achieve full-color printing in a compact printer, making it feasible to prepare full-color prints of superior color reproduction even in a space-limited working environment.

There will be described image formation using the toner of the invention. First, there will be described image formation using the toner of the invention as a two-component developer.

FIG. 1 illustrates an example of an image forming apparatus in which the toner of the invention is usable as a two-component developer.

In FIG. 1, 1Y, 1M, 1C and 1K each designate photoreceptors; 4Y, 4M, 4C and 4K each designate a developing means; 5Y, 5M, 5C and 5K each designate primary transfer rollers as a primary transfer means; BA designates a secondary transfer roller as a secondary transfer means; 6Y, 6M, 6C and 6K each designate cleaning means; the numeral 7 designates an intermediate transfer unit; the numeral 24 designates a thermal roll type fixing device; and the numeral 70 designates an intermediate transfer material.

This image forming apparatus is called a tandem color image forming apparatus, which is, as a main constitution, composed of plural image forming sections 10Y, 10M, 10C and 10B, an intermediate transfer material unit 7 as a transfer section including an endless belt form of a transfer belt, paper feeding and conveying means 22A to 22D to convey recording member P and heated roll-type fixing device 24 as a fixing means original image reading device SC is disposed in the upper section of image forming apparatus body A.

Image forming section 10Y to form a yellow image as one of different color toner images formed on the respective photoreceptors comprises drum-form photoreceptor 1Y as the first photoreceptor; electrostatic-charging means 2Y, exposure means 3Y and developing means 4Y which are disposed around the photoreceptor 1Y; primary transfer roller 5Y as a primary transfer means; and cleaning means 6Y.

Image forming section 10M to form a magenta image as one of different color toner images formed on the respective photoreceptors comprises drum-form photoreceptor 1M as the second photoreceptor; electrostatic-charging means 2M, exposure means 3M and developing means 4M which are disposed around the photoreceptor 1M; primary transfer roller 5M as a primary transfer means; and cleaning means 6M.

Image forming section 10C to form a cyan image as one of different color toner images formed on the respective photoreceptors comprises drum-form photoreceptor 1C as the third photoreceptor; electrostatic-charging means 2Y, exposure means 3C and developing means 4C which are disposed around the photoreceptor 1C; primary transfer roller 5C as a primary transfer means; and cleaning means 6C.

Image forming section 10K to form a black image as one of different color toner images formed on the respective photoreceptors comprises drum-form photoreceptor 1K as the fourth photoreceptor; electrostatic-charging means 2K, exposure means 3K and developing means 4K which are disposed around the photoreceptor 1K; primary transfer roller 5K as a primary transfer means; and cleaning means 6K.

Intermediate transfer unit 7 of an endless belt form is turned by plural rollers has intermediate transfer material 70 as the second image carrier of an endless belt form, while being pivotably supported.

The individual color images formed in image forming sections 10Y, 10M, 10C and 10K are successively transferred onto the moving intermediate transfer material (70) of an endless belt form by primary transfer rollers 5Y, 5M, 5C and 5K, respectively, to form a composite color image. Recording member P of paper or the like, as a final transfer material housed in paper feed cassette 20, is fed by paper feed and conveyance means 21 and conveyed to secondary transfer roller 5A through plural intermediate rollers 22A, 22B, 22C and 22D and resist roller 23, and color images are transferred together on recording member P. The color image-transferred recording member (P) is fixed by heat-roll type fixing device 24, nipped by paper discharge roller 25 and put onto paper discharge tray outside a machine.

After a color image is transferred onto recording member P by secondary transfer roller 5A, intermediate transfer material 70 which separated recording member P removes any residual toner by cleaning means 6A.

The primary transfer roller 5K is always compressed to the photoreceptor 1K. Other primary rollers 5Y, 5M and 5C are each the photoreceptors 1Y, 1M and 1C, respectively, only when forming color images.

Secondary transfer roller 5A is compressed onto intermediate transfer material 70 only when recording member P passes through to perform secondary transfer.

Housing 8, which can be pulled out from the apparatus body (A) through supporting rails 82L and 82R, is comprised of image forming sections 10Y, 10M, 10C and 10K and the intermediate transfer unit (7) of an endless belt form.

Image forming sections are arranged vertically in a line. Intermediate transfer material unit 7 of an endless belt form is disposed on the left side of photoreceptors 1Y, 1M, 1C and 1K, as indicated in FIG. 2. Intermediate transfer material unit 7 comprises the intermediate transfer unit (7) of an endless belt form which can be turned via rollers 71, 72, 73, 74 and 76, primary transfer rollers 5Y, 5M, 5C and 5K and cleaning means 6A.

The image forming sections 10Y, 10M, 10C and 10K and the intermediate transfer unit 7 are pulled out of the body A by pulling the housing 8.

In the process of image formation, toner images are formed on photoreceptors 1Y, 1M, 1C and 1K, through electrostatic-charging, exposure and development, toner images of the individual colors are superimposed on the endless belt form, intermediate transfer material (70), transferred together onto recording member P and fixed by compression and heating in heat-roll type fixing device 24. After completion of transferring a toner image to recording member P, intermediate transfer material 70 cleans any toner remained on the intermediate transfer material by cleaning device 6A and then goes into the foregoing cycle of electrostatic-charging, exposure and development to perform the subsequent image formation.

In the image forming method in which the toner relating to the invention is used as a non-magnetic single component developer, the above-described two component developing device may be replaced by a single component developing device.

A fixing method is not specifically limited and may be any one of a roller fixing system comprised of a heating roller and a pressure roller, a fixing system comprised of a heating roller and a pressure belt, a fixing system comprised of a heating belt and a pressure roller and a belt fixing system comprised of a heating belt and a pressure belt. A heating system may be any one of a halogen lamp system, IH fixing system and the like.

EXAMPLES

The embodiments of invention will be specifically described with reference to examples but the invention is by no means limited to these.

Example 1

Preparation of Toner 1 (Kneading/Grinding Method)

The toner constitution described below was placed in a HENSCHEL MIXER (produced Mitsui-Miike Kogyo Co., Ltd.) and mixed with stirring at a blade-circumferential speed of 25 m/sec for 5 min.

| | |
|---|---|
| Polyester resin* | 100 mass parts |
| C.I. Pigment Blue 76 | 5 mass parts |
| Releasing agent (pentaerythritol tetrastearate) | 6 mass parts |
| Charge controlling agent (boron dibenzylic acid) | 1 mass part |

*condensation product of bisphenol A/ethylene oxide adduct, terephthalic acid and trimeritic acid having a weight average molecular weight of 20,000

The mixture was kneaded by a biaxial extrusion kneader, roughly ground by a hammer mill, further ground by a turbo-mill (produced by TURBO KOGYO Co., Ltd.) and was subjected to a fine powder classification treatment by an air classifier employing Coanda effect to obtain colored particles having a volume-based median diameter of 5.5 μm.

Next, to the foregoing colored particles were added external additives described below and subjected to an external treatment in a HENSCHEL MIXER to obtain Toner 1.

Hexamethylsilane-treated silica (average primary particle size of 12 nm) 0.6 mass parts n-Octylsilane-treated titanium oxide (average primary particle size of 24 nm) 0.8 mass parts The external treatment in HENSCHEL MIXER was conducted under conditions of a stirring blade circumferential speed of 35 m/sec, a treatment temperature of 35° C. and a treatment time of 15 min.

Example 2

Preparation of Toner 2 (Emulsion Coagulation Method)

(1) Preparation of Particular Colorant Dispersion 1:

11.5 parts by mass of sodium n-dodecylsulfate was placed in 160 parts by mass of deionized water and dissolved with stirring to prepare an aqueous surfactant solution. To the aqueous surfactant solution was gradually added 40 parts by mass of C.I. Pigment Blue 76 and the foregoing composition was slowly added and dispersed by using CLEARMIX W-motion CLM-0.8 (produced by M Technique Co.) to obtain colorant microparticle dispersion 1.

Colorant microparticle 1 contained in the foregoing colorant microparticle dispersion 1 exhibited a volume-based median diameter of 98 nm. The volume-based median diameter was measured by using MICROTRAC UPA-150 (produced by HONEYWELL Corp.) according to the following conditions:

Sample refraction index: 1.59

Sample specific gravity: 1.05 (equivalent converted to spherical particle)

Solvent refraction index: 1.33

Solvent viscosity: 0.797 (30° C.), 1.002 (20° C.)

Zeropoint adjustment: Adjustment was made by adding deionized water to a measurement cell.

(2) Preparation of Core Resin Particle 1:

Resin particles used to form a core (denoted as core resin particle 1) having a multilayer structure was prepared by the steps of 1st polymerization, 2nd polymerization and 3rd polymerization.

(a) 1st Polymerization:

Into a reaction vessel fitted with a stirrer, a temperature sensor, a condenser and a nitrogen gas-introducing device was added 4 parts by mass of anionic surfactant (Formula 1) together with 3040 parts by mass of deionized water to prepare an aqueous surfactant solution.

$$C_{10}H_{21}(OCH_2CH_2)_2SO_3Na \qquad \text{Formula 1}$$

To the foregoing aqueous surfactant solution was added a polymerization initiator solution of 10 parts by weight of potassium persulfate (KPS) dissolved in 400 parts by weight of deionized water and after the temperature was raised to 75° C., a monomer solution which was comprised of compounds as below was dropwise added to the reaction vessel over 1 hr.

| | |
|---|---|
| Styrene | 532 mass parts |
| n-Butyl acrylate | 200 mass parts |
| Methacrylic acid | 68 mass parts |
| n-Octylmercaptan | 16.4 mass parts |

After completing addition of the monomer solution, the reaction mixture was heated with stirring at 75° C. for 2 hrs. to perform polymerization (1st polymerization) to obtain resin particles. The obtained resin particles were designated as particulate resin A1. The weight-average molecular weight of the particulate resin A1 was 16,500.

(b) 2nd Polymerization:

To a flask fitted with a stirrer was added a mixed monomer solution of compounds describe below and subsequently, 93.8 parts by weight of paraffin wax HNP-57 (produced Nippon Seiro Co., Ltd.) as a releasing agent was added and dissolved with heating at 90° C. to prepare a monomer solution.

| | |
|---|---|
| Styrene | 101.1 mass parts |
| n-Butyl acrylate | 62.2 mass parts |
| Methacrylic acid | 12.3 mass parts |
| n-Octylmercaptan | 1.75 mass parts |

An aqueous surfactant solution was prepared by dissolving 3 parts by mass of the foregoing anionic surfactant in 1560 parts by mass of deionized water and heated at 98° C. To this aqueous surfactant solution was added the foregoing particulate resin A1 in an amount of 32.8 parts by mass (equivalent converted to solids), and the paraffin wax-containing monomer solution described above was added and was dispersed for 8 hrs. using a mechanical stirrer having a circulation pass, CLEARMIX (produced by M Technique Co.). There was thus prepared an emulsified particle dispersion comprised of emulsion particles having a dispersion particle size of 340 nm.

Subsequently, to the foregoing emulsified particle dispersion was added a polymerization initiator solution of 6 parts by mass of potassium persulfate dissolved in 200 parts by mass of deionized water. This reaction mixture was heated at 98° C. for 12 hrs. to undergo polymerization (2nd polymerization) to prepare resin particles. The thus prepared resin particles were designated as particulate resin A2. The weight-average molecular weight of the particulate resin A2 was 23,000.

(c) 3rd Polymerization:

To the particulate resin A2 obtained in the 2nd polymerization step was added a polymerization initiator solution of 5.45 parts by mass of potassium persulfate dissolved in 220 parts by mass of deionized water and a mixed monomer solution composed of the following compounds was dropwise added to the reaction vessel at 80° C. in 1 hr.

| | |
|---|---|
| Styrene | 293.8 mass parts |
| n-Butyl acrylate | 154.1 mass parts |
| n-Octylmercaptan | 7.08 mass parts |

After completing addition, the reaction mixture was heated with stirring for 2 hrs. to undergo polymerization (3rd polymerization). After completing polymerization, the reaction mixture was cooled to 28° C. to obtain core resin particle 1. The weight-average molecular weight of the core resin particle 1 was 26,800.

(3) Preparation of Shell Resin Particle:

Resin particles used for shell (denoted as shell resin particle 1) were prepared similarly to the 1st polymerization of the foregoing core resin particle 1, provided that the composition of the monomer solution used in the 1st polymerization was changed as below.

| | |
|---|---|
| Styrene | 624 mass parts |
| 2-Ethylhexyl acrylate | 120 mass parts |
| Methacrylic acid | 56 mass parts |
| n-Octylmercaptan | 16.4 mass parts |

(4) Preparation of Toner 2

Toner 2 was prepared according to the procedure below.

(a) Formation of Core:

Into a reaction vessel fitted with a stirrer, a temperature sensor, a condenser and a nitrogen gas introducing device was placed the following composition:

| | |
|---|---|
| Core resin particle (equivalent converted to solid) | 420.7 mass parts |
| Deionized water | 900 mass parts |
| Colorant particle dispersion 1 | 200 mass parts |

The interior of the reaction vessel was adjusted to 30° C. and the pH was adjusted to 8-11 with an aqueous 5 mol/L sodium hydroxide solution.

Subsequently, further thereto, an aqueous solution of 2 parts by mass of magnesium chloride hexahydrate dissolved in 1000 parts by weight of deionized water was added at 30° C. for 10 min. After allowed to stand for 3 min., the mixture was heated to 65° C. in 60 min. to perform coagulation. Using MULTISIZER 3 (Coulter Co.), the dispersion was measured as such with respect to coagulated particle size and when coagulated particles reached a volume-based median diameter of 5.5 μm, there was added an aqueous solution of 40.2 parts by mass of sodium chloride dissolved in 1000 parts by mass of deionized water to terminate coagulation.

After terminating coagulation, ripening was conducted at 70° C. for 1 hr. to allow fusion to continue, whereby core 1 was prepared. The average circularity of the core 1, which was measured by FPIA 2100 (produced by SYSTEX Co. Ltd.), was 0.912.

(b) Formation of Shell:

Next, to the foregoing solution maintained at 65° C. was added 96 parts by mass of shell resin particle 1. Further thereto, an aqueous solution of 2 parts by mass of magnesium chloride hexahydrate dissolved in 1000 parts by mass of deionized water was added in 10 min. and the reaction mixture was heated to 70° C. and stirred for 1 hr. Thus, the shell resin particle 1 was melted onto the surface of the core 1 and ripening was carried out for 20 min to form a shell.

Thereafter was added an aqueous solution of 40.2 parts by mass of sodium chloride dissolved in 1000 parts by mass to terminate shell formation. The reaction mixture was cooled to 30° C. at a cooling rate of 8° C./min. The colored particles thus formed were filtered off and repeatedly washed with deionized water of 45° C., and dried with hot air of 40° C. to prepare colored particle 2 having a shell on the core surface.

(c) External Additive Treatment:

The colored particle 2 was added with the following external additives and subjected to an external treatment with stirring in a HENSCHEL MIXER to prepare toner 2.

| | |
|---|---|
| Hexamethylsilane-treated silica (average primary particle size of 12 nm) | 0.6 mass parts |
| n-Octylsilane-treated titanium oxide (average primary particle size of 24 nm) | 0.8 mass parts |

The external treatment in a Henschel mixer was conducted under conditions of a stirring blade circumferential speed of 35 m/sec, a treatment temperature of 35° C. and a treatment time of 15 min.

Comparative Example 1

Preparation of Comparative Toner 1

Comparative toner 1 was prepared similarly to Example 1, provided that C.I. Pigment Blue 76 was replaced by copper phthalocyanine.

Comparative Example 2

Preparation of Comparative Toner 2

Comparative toner 2 was prepared similarly to Example 2, provided that C.I. Pigment Blue 76 was replaced by copper phthalocyanine.

Preparation of Yellow Toner 1

Yellow toner 1 was prepared similarly to Example 1, provided that C.I. Pigment Blue 76 was replaced by C.I. Pigment Yellow 74.

Preparation of Yellow Toner 2

Yellow toner 2 was prepared similarly to Example 2, provided that C.I. Pigment Blue 74 was replaced by C.I. Pigment Yellow 74.

Preparation of Magenta Toner 1

Magenta toner 1 was prepared similarly to Example 1, provided that C.I. Pigment Blue 76 was replaced by C.I. Pigment Red 122.

Preparation of Magenta Toner 2

Magenta toner 2 was prepared similarly to Example 2, provided that C.I. Pigment Blue 76 was replaced by C.I. Pigment Red 122.

Preparation of Black Toner 1

Black toner 1 was prepared similarly to Example 1, provided that C.I. Pigment Blue 76 was replaced by Carbon Black: Mogul L.

Preparation of Black Toner 2

Black toner 2 was prepared similarly to Example 2, provided that C.I. Pigment Blue 76 was replaced by Carbon Black: Mogul L.

Preparation of Developer

Each of the foregoing Toners 1 and 2, Comparative toners 1 and 2, Yellow toners 1 and 2, Magenta toners 1 and 2, and Black toners 1 and 2 was mixed with a ferrite carrier which was covered with methyl methacrylate and cyclohexyl methacrylate resin and exhibited a volume average particle size of 50 μm to prepare Developers 1 and 2, Comparative developers 1 and 2, Yellow developers 1 and 2, magenta developers 1 and 2, and Black developers 1 and 2, each having a toner content of 6%.

Evaluation

Evaluation was conducted by using a commercially available composite printer, bizhub Pro C500 (produced by Konica Minolta Business Technologies Inc.) into which a developing device having combined developers was loaded.

Such combined developers are as follows.

Inventive Developer 1:

Developer 1/Yellow developer 1/Magenta developer 1/Black developer 1

Inventive Developer 2:

Developer 2/Yellow developer 2/Magenta developer 2/Black developer 1

Comparative Developer 1:

Comparative developer 1/Yellow developer 1/Magenta developer 1/Black developer 1

Comparative Developer 2:

Comparative developer 2/Yellow developer 2/Magenta developer 2/Black developer 2

Using four kinds of developers described above, evaluation was conducted as below.

Color Reproduction:

A full-color image obtained by using the foregoing developers was evaluated with respect to range of color reproduction of a full-color image. Thus, solid images (2 cm×2 cm) of yellow (Y), magenta (M), cyan (C), red (R), Blue (B) and green (G) were each formed by using the foregoing developers under an environment at a temperature of 20° C. and a humidity of 50% RH, the color gamut thereof was represented in a*b* coordinates and the area (color gamut area) was measured. The color reproduction range was represented by a relative value, based on the area constituted of a color gamut of Y/M/C/R/G/B obtained by comparative developer 1 being 100. A color gamut area of 120 or more resulted in reduced uncomfortable feeling when viewing a computer display. Evaluation results are as follows:

Inventive developer 1: color gamut are=121

Inventive developer 2: color gamut are=131

Comparative developer 1: color gamut are=100

Comparative developer 2: color gamut are=102

Thus, the use of the toner of the invention achieved expansion of color gamut.

Lightfastness:

A cyan image of 10 cm×10 cm was prepared by each of the foregoing inventive developer 1, inventive developer 2, comparative developer 1 and comparative developer 2. Subsequently, using XENON WEATHER METER 1-XL 75, the thus prepared images were exposed to light under 70,000 lux of a xenon lamp for 480 hrs to determine a rate of variation in reflection density between before and after exposure. The rate of variation in reflection density is defined as below:

$$\text{Rate of variation (\%)}=[(\text{reflection density before exposure})-[(\text{reflection density after exposure})]\times 100/(\text{reflection density before exposure})$$

The rate of variation in density between before and after exposure is as follows:

Inventive developer 1: rate of variation=0.2%

Inventive developer 2: rate of variation=0.2%

Comparative developer 1: rate of variation=8.7%

Comparative developer 2: rate of variation=8.7%

As can be seen from the foregoing results, it was proved that lightfastness of images formed by using the toner for electrostatic image development, relating to the invention was superior to those of comparison.

What is claimed is:

1. An electrophotographic toner comprising a resin and a colorant, wherein the colorant comprises a pigment of C.I. Pigment Blue 76.

2. The toner of claim 1, wherein the pigment of C.I. Pigment Blue 76 is contained in an amount of from 1 to 10% by mass of the toner.

3. The toner of claim 1, wherein the pigment of C.I. Pigment Blue 76 is contained in the form of particles having a number average primary particle size of from 10 to 300 nm.

4. The toner of claim 1, wherein the colorant further comprises a cyan pigment in an amount of less than 50% by mass of the pigment of C.I. Pigment Blue 76.

5. The toner of claim 1, wherein the colorant is contained in an amount of from 1 to 10% by mass of the toner.

6. The toner of claim 1, wherein the toner comprises toner particles having a volume-based median diameter of from 3 to 8 μm.

7. The toner of claim 1, wherein the toner comprises toner particles having a coefficient of variation of volume-based particle size distribution of from 2 to 21%.

8. The toner of claim 1, wherein the toner exhibits a softening point of from 70 to 110° C.

9. The toner of claim 1, wherein the resin comprises a polymer formed of at least a monomer having at least one selected from the group of a carboxyl group, a sulfonic acid group and a phosphoric acid group.

10. An electrophotographic toner comprising a resin and a colorant, wherein the colorant comprises a pigment represented by the formula:

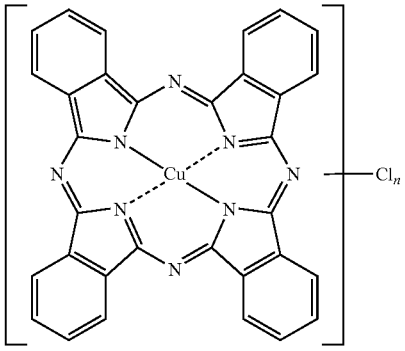

wherein n is 10.

11. A full-color toner kit comprising a yellow toner comprising a yellow colorant and a binder, a magenta toner comprising a magenta colorant and a binder, a cyan toner comprising a cyan colorant and a binder and a black toner comprising a black colorant and a binder, wherein the cyan colorant comprises a pigment of C.I. Pigment Blue 76.

12. An image forming method comprising performing image formation by using at least four toners comprised of a yellow toner comprising a yellow colorant and a resins a magenta toner comprising a magenta colorant and a resin, a cyan toner comprising a cyan colorant and a resin and a black toner comprising a black colorant and a resin, wherein the cyan colorant comprises a pigment of C.I. Pigment Blue 76.

* * * * *